US010087540B2

(12) United States Patent
Cao et al.

(10) Patent No.: US 10,087,540 B2
(45) Date of Patent: Oct. 2, 2018

(54) SURFACE MODIFIERS FOR IONIC LIQUID ALUMINUM ELECTROPLATING SOLUTIONS, PROCESSES FOR ELECTROPLATING ALUMINUM THEREFROM, AND METHODS FOR PRODUCING AN ALUMINUM COATING USING THE SAME

(71) Applicant: HONEYWELL INTERNATIONAL INC., Morristown, NJ (US)

(72) Inventors: Gangmin Cao, Shanghai (CN); Jingkang Lv, Shanghai (CN); James Piascik, Randolph, NJ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 239 days.

(21) Appl. No.: 14/624,254

(22) Filed: Feb. 17, 2015

(65) Prior Publication Data

US 2016/0237580 A1 Aug. 18, 2016

(51) Int. Cl.

| | |
|---|---|
| ***C25D 3/66*** | (2006.01) |
| ***C25D 3/44*** | (2006.01) |
| *C25D 5/48* | (2006.01) |
| *C25D 5/50* | (2006.01) |

(52) U.S. Cl.

CPC ..... *C25D 3/44* (2013.01); *C25D 3/665* (2013.01); *C25D 5/48* (2013.01); *C25D 5/50* (2013.01)

(58) Field of Classification Search

CPC ..... C25D 3/665
USPC ..... 205/233, 237
See application file for complete search history.

(56) References Cited

U.S. PATENT DOCUMENTS

| | | | |
|---|---|---|---|
| 2,133,995 | A | 10/1938 | Lukens |
| 2,299,054 | A | 10/1942 | Harshaw |
| 2,457,061 | A | 12/1948 | McQuire |
| 2,936,269 | A | 5/1960 | Gendvil |
| 3,129,149 | A | 4/1964 | Johnson |
| 3,600,284 | A | 8/1971 | Martinez et al. |
| 3,607,413 | A | 9/1971 | Buzzelli |
| 3,634,207 | A | 1/1972 | Toledo |
| 4,123,594 | A | 10/1978 | Chang |
| 4,463,071 | A | 7/1984 | Gifford et al. |
| 4,747,916 | A | 5/1988 | Kato et al. |

(Continued)

FOREIGN PATENT DOCUMENTS

| | | | |
|---|---|---|---|
| CN | 101914792 | A | 12/2010 |
| CN | 101994128 | A * | 3/2011 |

(Continued)

OTHER PUBLICATIONS

Machine translation of CN101994128 of Cunying et al, published Mar. 30, 2011.*

(Continued)

*Primary Examiner* — Brian W Cohen
(74) *Attorney, Agent, or Firm* — Lorenz & Kopf, LLP

(57) ABSTRACT

Ionic liquid aluminum electroplating solutions are provided. The ionic liquid aluminum electroplating solution comprises an ionic liquid, an aluminum salt, and an effective amount of propylene carbonate. Methods for producing an aluminum coating on a substrate are also provided. Processes for electroplating aluminum or an aluminum alloy from an ionic liquid aluminum electroplating solution are also provided.

13 Claims, 4 Drawing Sheets

(56) References Cited

U.S. PATENT DOCUMENTS

| | | | | |
|---|---|---|---|---|
| 4,789,441 | A | 12/1988 | Foster et al. | |
| 4,801,363 | A | 1/1989 | Gregory | |
| 4,810,334 | A | 3/1989 | Honey et al. | |
| 4,849,060 | A | 7/1989 | Smit et al. | |
| 4,904,355 | A | 2/1990 | Takahashi | |
| 4,906,342 | A | 3/1990 | Takahashi et al. | |
| 5,037,513 | A | 8/1991 | Foster | |
| 5,074,973 | A | 12/1991 | Takahashi et al. | |
| 5,681,661 | A | 10/1997 | Kelly | |
| 5,743,013 | A | 4/1998 | Taylor et al. | |
| 5,856,027 | A | 1/1999 | Murphy | |
| 6,113,770 | A | 9/2000 | Rasmussen | |
| 6,123,997 | A | 9/2000 | Schaeffer et al. | |
| 6,221,181 | B1 | 4/2001 | Bossmann et al. | |
| 6,280,857 | B1 | 8/2001 | Sommer et al. | |
| 6,291,014 | B1 | 9/2001 | Warnes et al. | |
| 6,695,960 | B1 | 2/2004 | Bacos et al. | |
| 6,974,636 | B2 | 12/2005 | Darolia et al. | |
| 6,998,151 | B2 | 2/2006 | Grylls et al. | |
| 7,569,131 | B2 | 8/2009 | Hixon-Goldsmith et al. | |
| 7,939,205 | B2 | 5/2011 | Klaassen | |
| 7,989,020 | B2 | 8/2011 | Strangman et al. | |
| 8,354,189 | B2 | 1/2013 | Pham et al. | |
| 8,778,164 | B2 | 7/2014 | Piascik et al. | |
| 2001/0031375 | A1 | 10/2001 | Bugnet et al. | |
| 2001/0054557 | A1 | 12/2001 | Taylor et al. | |
| 2002/0132132 | A1 | 9/2002 | Bose et al. | |
| 2003/0211239 | A1 | 11/2003 | Grylls et al. | |
| 2005/0064228 | A1 | 3/2005 | Darolia et al. | |
| 2007/0196670 | A1 | 8/2007 | Barshilia et al. | |
| 2007/0227895 | A1 | 10/2007 | Bishop et al. | |
| 2007/0275305 | A1 | 11/2007 | Omote | |
| 2008/0107805 | A1 | 5/2008 | Palumbo et al. | |
| 2008/0142372 | A1 | 6/2008 | Laser et al. | |
| 2008/0193663 | A1 | 8/2008 | Strangman et al. | |
| 2008/0199722 | A1 | 8/2008 | Apte et al. | |
| 2008/0246580 | A1 | 10/2008 | Braun et al. | |
| 2008/0272004 | A1 | 11/2008 | Roth-Fagaraseanu | |
| 2009/0114544 | A1 | 5/2009 | Rousseau et al. | |
| 2009/0236227 | A1 | 9/2009 | Kuzmanovic et al. | |
| 2010/0108524 | A1 | 5/2010 | van Mol et al. | |
| 2010/0243464 | A1 | 9/2010 | Gualtieri et al. | |
| 2010/0261034 | A1 | 10/2010 | Cardarelli | |
| 2011/0083967 | A1 | 4/2011 | Ruan et al. | |
| 2012/0031766 | A1* | 2/2012 | Inoue | C25D 3/44 205/102 |
| 2012/0312692 | A1 | 12/2012 | Kimura et al. | |
| 2013/0168258 | A1 | 7/2013 | Nakano et al. | |
| 2013/0302641 | A1 | 11/2013 | Zhang et al. | |
| 2013/0341197 | A1 | 12/2013 | Piascik et al. | |
| 2014/0272458 | A1* | 9/2014 | Ruan | C25D 3/44 428/650 |
| 2016/0108534 | A1* | 4/2016 | Dai | C25D 5/02 205/117 |

FOREIGN PATENT DOCUMENTS

| | | | |
|---|---|---|---|
| CN | 102041532 | A | 5/2011 |
| EP | 0184985 | A2 | 6/1986 |
| EP | 1533401 | A1 | 5/2005 |
| EP | 1956118 | A2 | 8/2008 |
| EP | 2 330 233 | A1 | 6/2011 |
| EP | 2623644 | A1 | 8/2013 |
| GB | 503008 | | 11/1938 |
| JP | 2004035902 | A | 2/2004 |
| JP | 2004035911 | A | 2/2004 |
| WO | 2006036171 | A1 | 4/2006 |
| WO | 2008/127112 | A2 | 10/2008 |
| WO | 2009139833 | A2 | 11/2009 |
| WO | 2010097577 | A1 | 9/2010 |

OTHER PUBLICATIONS

Extended EP Search Report for Application No. 16154946.4-1373 / 3059335 dated Oct. 24, 2016.

Partial EP Search Report for Application No. 16154946.4-1373 dated Jul. 5, 2016.

N'Gandu-Muamba, J. et al. "The Reactive Element Effect (R.E.E.): A Tentative Classification," Journal De Physique IV, Colloque C9, Supplement au Journal de Physique III, vol. 3, Dec. 1993, pp. 281-290.

Von K. Jopp, L. "Aluminiumabscheidung Mit Ionischen Flussigkeiten, Elegant Deposition of Aluminum from Ionic Liquids," Galvanotechnik, Oct. 2009, pp. 2238-2241.

EP Search Report for EP 13 152 283.1, dated Jul. 5, 2013.

EP Communication, EP 13152283.1-1359 dated Aug. 14, 2013.

USPTO Office Action for U.S. Appl. No. 12/970,592 dated Oct. 24, 2013.

USPTO Notice of Allowance and Fee(s) Due for U.S. Appl. No. 12/970,592.

EP Examination Report for Application No. 13152283.1, dated Jun. 26, 2014.

EP Search Report, 11 193 119.2, dated May 8, 2012.

EP Communication, EP 11 193 119.2, dated May 29, 2012.

USPTO Office Action for U.S. Appl. No. 12/970,592; dated May 24, 2013.

Lowenheim, F.A.; Electroplating, McGraw-Hill Book Company, New York, 1978, pp. 67-81, 99-112.

Abbott, A. P., McKenzie K. J., "Application of ionic liquids to the electrodeposition of metals", Physical Chemistry Chemical Physics (http://pubs.rsc.org), 2006, 8, 4265-4279.

Endes, F., "Ionic Liquids: Solvents for the Electrodeposition of Metals and Semiconductors", Chemphyschem 2002, 3, 144-154.

USPTO Office Action for U.S. Appl. No. 13/366,759 dated Dec. 22, 2016.

Bard, "Electrochemical Dictionary," (2008).

Lou, Helen H. and Yinlun Huang, "Electroplating," (2006).

USPTO Office Action, dated Oct. 8, 2015; U.S. Appl. No. 13/366,759.

Schaschke; "A Dictionary of Chemical Engineering," Heat Treatment, p. 180, 2014.

USPTO Office Action, dated Apr. 28, 2016; U.S. Appl. No. 13/366,759.

Vossen et al, Thin Film Processes 245 (1978).

Knovel Corp., Knovel Critical Tables (2008).

USPTO Notice of Allowance for U.S. Appl. No. 13/366,759 dated May 26, 2017.

* cited by examiner

SURFACE MODIFIERS FOR IONIC LIQUID ALUMINUM ELECTROPLATING SOLUTIONS, PROCESSES FOR ELECTROPLATING ALUMINUM THEREFROM, AND METHODS FOR PRODUCING AN ALUMINUM COATING USING THE SAME

TECHNICAL FIELD

The present invention generally relates to aluminum electroplating solutions, and more particularly relates to surface modifiers for ionic liquid aluminum electroplating solutions, processes for electroplating aluminum therefrom, and methods for producing an aluminum coating using the same.

BACKGROUND

An aluminum coating may endow a substrate with certain benefits including corrosion resistance, oxidation resistance, enhanced appearance, wear resistance, improved performance, etc. There are several drawbacks to conventional aluminum deposition techniques such as chemical vapor deposition, pack cementation, and electroplating. Conventional aluminum electroplating is complex, costly, performed at high temperatures, and/or requires the use of flammable solvents and pyrophoric compounds that decompose, evaporate, and are oxygen-sensitive, necessitating costly specialized equipment and presenting serious operational challenges to a commercial production facility.

Ionic liquids with aluminum salts ("ionic liquid aluminum electroplating solutions") have also been used to electroplate aluminum on superalloy substrates and non-superalloy substrates (e.g., steel). While such ionic liquid aluminum electroplating solutions are known to produce a high purity (greater than about 99.5%), dense coating, the coating may include dendrites (a crystal or crystalline mass with a branching, treelike structure) and/or nodules (small rounded lumps of matter distinct from their surroundings) (collectively referred to herein as "coating defects"), resulting in less than optimal coating uniformity and possible coating spallation, particularly when the coating thickness is greater than 25 micrometers (μm). The addition of conventional electroplating bath additives known as surface modifiers (also known as leveling agents) to the conventional ionic liquid aluminum electroplating solution has not eliminate these problems.

Accordingly, it is desirable to provide effective surface modifiers for ionic liquid aluminum electroplating solutions, processes for electroplating aluminum therefrom, and methods for producing an aluminum coating using the same. The surface modifier increases throwing power and inhibits coating defects in the aluminum coating produced from the ionic liquid aluminum electroplating solution containing the surface modifier. The surface modifier also provides better coating uniformity with improved surface morphology and reduced coating defects, longer plating bath life and a higher plating rate relative to electroplating with conventional ionic liquid aluminum electroplating solutions.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

Ionic liquid aluminum electroplating solutions are provided in accordance with exemplary embodiments of the present invention. The ionic liquid aluminum electroplating solution comprises an ionic liquid, an aluminum salt, and an effective amount of propylene carbonate.

Methods are provided for producing an aluminum coating on a substrate in accordance with yet other exemplary embodiments of the present invention. The method comprises applying aluminum or an aluminum alloy to at least one surface of the substrate by electroplating under electroplating conditions in an ionic liquid aluminum electroplating solution comprising an ionic liquid, an aluminum salt, and an effective amount of propylene carbonate.

Processes are provided for electroplating aluminum or an aluminum alloy from an ionic liquid aluminum electroplating solution in accordance with yet other exemplary embodiments of the present invention. The process comprises adding an effective amount of propylene carbonate to an ionic liquid and aluminum salt solution thereby forming the ionic liquid aluminum electroplating solution. At least one surface of a substrate is electroplating under electroplating conditions in the ionic liquid aluminum electroplating solution to form an aluminum coating on the substrate.

Furthermore, other desirable features and characteristics of the ionic liquid aluminum electroplating solution, processes, and methods will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figure, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Various embodiments are directed to surface modifiers for use in ionic liquid aluminum electroplating solutions, processes for electroplating aluminum therefrom, and methods for producing an aluminum coating using the same. Unless otherwise indicated, the term "aluminum" as used herein includes both aluminum metal and aluminum alloys. According to exemplary embodiments of the present invention, the ionic liquid aluminum electroplating solution comprises an ionic liquid, an aluminum salt, and propylene carbonate as a surface modifier. As used herein, the term "ionic liquid" refers to salts that are liquid at temperatures below 100° C. due to their chemical structure, comprised of mostly voluminous, organic cations and a wide range of ions. They do not contain any other non-ionic components such as organic solvents or water. Ionic liquids are not flammable or pyrophoric and have low or no vapor pressure, and therefore do not evaporate or cause emissions. The aluminum coating produced from the ionic liquid aluminum electroplating solution containing propylene carbonate is substantially uniform with improved surface morphology relative to coatings produced from ionic liquid aluminum electroplating solutions without propylene carbonate. In addition, the resulting coatings are substantially free of dendrites and nodules (hereinafter referred to collectively as "coating defects"). In addition, the ionic liquid aluminum electroplating solutions containing propylene carbonate have a longer plating bath life, provide a higher plating rate, and increased throwing power relative to conventional ionic liquid aluminum electroplating solutions. As used herein, the "throwing power" of an electroplating solution is a measure of the ability of that solution to plate to a uniform thickness over a cathode of irregular shape. If an irregularly shaped cathode is plated to a uniform thickness over its entire area, the solution would be said to have a perfect throwing power. If it is plated only on those areas nearest to the anodes, then the solution has a very poor throwing power.

Figure 1:
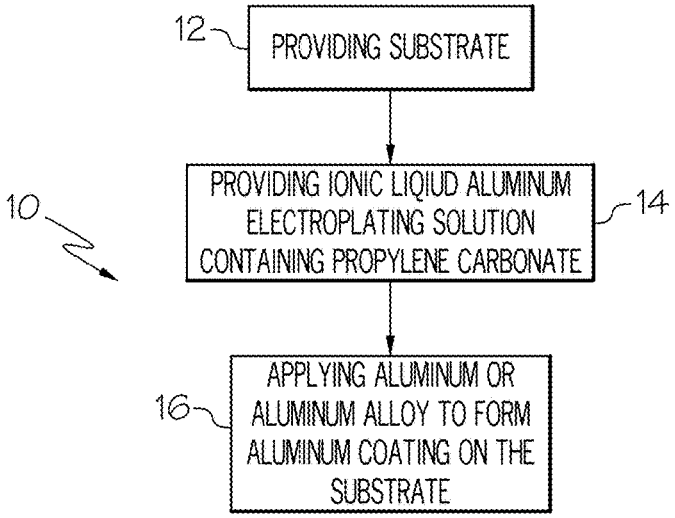
FIG. 1 is a flow diagram of a method for producing an aluminum coating using propylene carbonate as a surface modifier in an ionic liquid aluminum electroplating solution, according to exemplary embodiments of the present invention.
Figure 2:
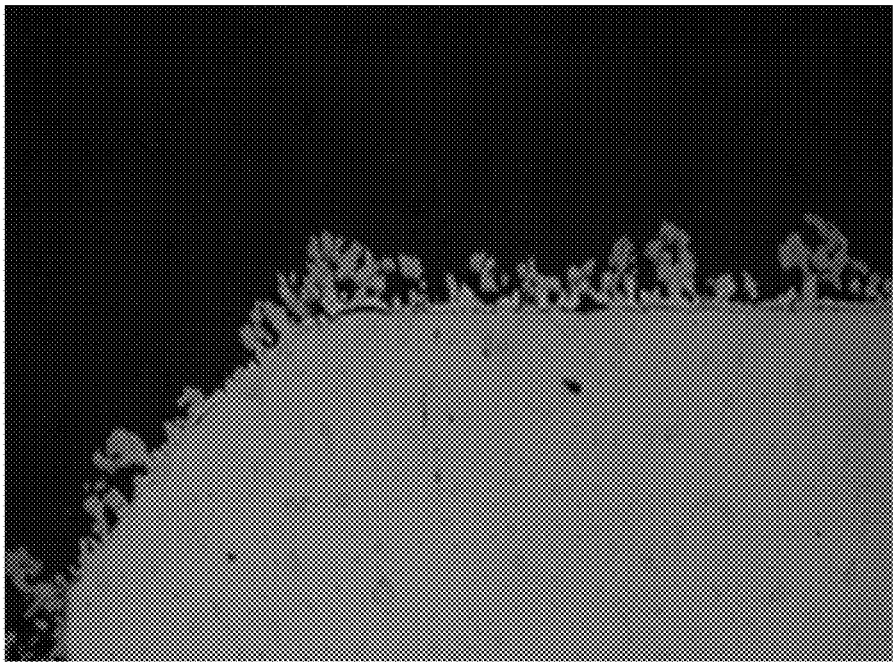
FIGS. 2 through 5 are photographs (as seen by a metallurgy microscope) of the cross-section of the electroplated aluminum deposits from using various ionic liquid aluminum electroplating solutions identified in TABLE 1.

Referring to FIG. 1, a method 10 for producing an aluminum coating on a substrate begins by providing the substrate (step 12). The substrate may be comprised of an alloy, such as a superalloy, or other materials that may benefit from an aluminum coating (e.g., steel, etc.). Exemplary alloys for the component include a cobalt-based alloy, a nickel-based alloy (e.g., MAR-M-247® alloy and SC180 alloy (a nickel-based single crystal alloy)), or a combination thereof. The surface portions of the substrate to be coated may be activated by pre-treating to remove oxide scale on the substrate. The oxide scale may be removed by, for example, wet blasting with abrasive particles, by chemical treatment, or by other methods as known in the art.

Certain surface portions of the substrate are not coated and therefore, these surface portions may be covered (masked) prior to electroplating the substrate as hereinafter described and as known in the art. Alternatively or additionally, surface portions where the coating is to be retained may be masked after electroplating followed by etching away the unmasked coating with a selective etchant that will not etch the substrate. Suitable exemplary mask materials include glass or Teflon® non-stick coatings. The Teflon® non-stick coatings are used for masking during plating due to the reactivity of the plating bath. If the substrate is entirely coated and then stripped after electroplating, portions of the substrate may be masked with conventional acid/base resistant etch resists such as KIWOPRINT® Z 865 Etch. Suitable exemplary etchants include, for example, $HNO_3$, KOH, NaOH, LiOH, dilute HCl, $H_2SO_4$, $H_2SO_{41}H_3PO_4$, commercial etchants containing $H_3PO_4$, $HNO_3$/acetic acid, or the like. The masking step, may be performed prior to, after, or both prior and after electroplating. When the masking step is performed prior to electroplating, the mask material used is compatible with ionic liquids. As the electroplating is performed at relatively low temperatures (less than about 100° C.), low temperature masking techniques may be used. Plastic masking materials such as, for example, a Teflon® non-stick mask are suitable and can be quickly placed on the areas not to be coated either as tape wrapped or as a preform which acts as a glove. Such masks may be relatively quickly applied and quickly removed and can be reused, making such low temperature masking techniques much less expensive and time consuming than conventional high temperature masking techniques.

Still referring to FIG. 1, method 10 for producing an aluminum coating on a substrate continues by providing an ionic liquid aluminum electroplating solution (step 14). Step 14 may be performed prior to, simultaneously with, or after step 12 as long as step 14 is performed prior to step 16. As noted previously, the ionic liquid aluminum electroplating solution comprises an ionic liquid, an aluminum salt (e.g., $AlCl_3$) and, in accordance with exemplary embodiments of the present invention, propylene carbonate as a surface modifier. A suitable exemplary ionic liquid and aluminum salt solution is commercially available from, for example, BASF Corporation, Rhineland-Palatinate, Germany and includes 1-ethyl-3-methylimidazolium chloride and $AlCl_3$ (EMIM-Cl×$AlCl_3$) and is marketed under the trade name BASF Basionics™ Al 01. The BASF Basionics Al 01 ionic liquid and aluminum salt solution consists of 40 mol % EMIM-Cl to 60 mol % aluminum chloride ($AlCl_3$), has a molar ratio of 1.0 to 1.5, and the following weight percentages of 1-ethyl-3-methylimidazolium chloride and aluminum salt ($AlCl_3$): 42.3 wt % EMIM Cl and 57.7 wt % $AlCl_3$. The weight percentage of $AlCl_3$ in EMIM-Cl ionic liquid may vary +/−25%, i.e., 43 to 72 wt % in the above example. There are no additives in the BASF Basionics Al01 ionic liquid and aluminum salt solution. IoLiTEC EP-0001 available from IoLiTec Ionic Liquids Technologies Inc., Tuscaloosa, Ala. (USA) may also be used as the ionic liquid and aluminum salt solution.

Other suitable ionic liquids, aluminum salts, and ionic liquid and aluminum salt solutions for use in the ionic liquid aluminum electroplating solution may be commercially available or prepared. For example, possible suitable anions other than chloride anions that are soluble in the ionic liquid aluminum electroplating solution and can be used in the aluminum salt include, for example, acetate, hexafluorophosphate, and tetrafluoroborate anions as determined by the quality of the deposit. In addition, it may be possible to use a BMIM CL: $AlCl_3$ (1-Butyl-3-methylimidazolium and aluminum salt) ionic liquid and aluminum salt solution marketed under the trade name IoLiTEC EP-0002 by IoLiTec Ionic Liquids Technologies Inc. Alternatively, plating baths (equivalent to BASF Basionics Al01 and IoLiTEC EP-0001 ionic liquid and aluminum salt solution) of EMIM Cl and $AlCl_3$ may be prepared by mixing EMIM Cl (available, for example, from Sigma Aldrich) and $AlCl_3$ (also available from Sigma Aldrich).

As noted previously, in accordance with exemplary embodiments of the present invention, the ionic liquid aluminum electroplating solution comprises propylene carbonate having the chemical formula $C_4H_6O_3$ (also known as 1,2-Propanediol carbonate or 4-Methyl-2-oxo-1,3-dioxolane) at a concentration of between about 0 to about 10 weight percent (wt %) (i.e., greater than 0 wt %) (an "effective amount") of the ionic liquid aluminum electroplating solution, preferably from about 3 to about 6 wt %. The weight percent of ionic liquid and aluminum salt comprises about 90 to about 100 weight percent. As used herein, the term "about 100 weight percent" means less than 100 weight percent to account for inclusion of at least propylene carbonate in the ionic liquid aluminum electroplating solution. Substantially pure propylene carbonate is available commercially from a number of suppliers including, for example, Huntsman Corporation (U.S.A.) and Sigma-Aldrich Corporation (U.S.A). According to exemplary embodiments of the present invention, a process for electroplating aluminum or an aluminum alloy from the ionic liquid aluminum electroplating solution begins by adding and mixing the effective amount of propylene carbonate to the ionic liquid and aluminum salt solution.

The propylene carbonate is electrochemically stable. The propylene carbonate acts as a surface modifier in the ionic liquid aluminum electroplating solution, leveling the metal or alloy deposit, increasing throwing power, and minimizing dendrite and nodule growth in the aluminum coating to be produced. The propylene carbonate improves coating surface morphology and substantially eliminates coating defects in the coating to be produced according to exemplary embodiments of the present invention. An effective amount of propylene carbonate in the ionic liquid aluminum electroplating solution also improves the process of electroplating from the ionic liquid aluminum electroplating solution as hereinafter described.

In another exemplary embodiment of the present invention, as shown below in TABLE 1 and corresponding FIGS. 2 through 5, the ionic liquid aluminum electroplating solution may further comprise at least one additive (i.e., a solvent or surfactant) that synergistically works with the propylene carbonate in the ionic liquid aluminum electroplating solution to further improve throwing power and coating density, including in sharp edges and corners of the substrate (e.g., a component). The solvent or surfactant may be, for example, sodium dodecyl sulfate, 1-Methyl-2-pyrrolidone, or the like and comprising about 1 wt % to about 6 wt % of the ionic liquid aluminum plating bath (an "effective amount"). Other suitable solvents/surfactants include those that have relatively low vapor pressure and a relatively high flashpoint.

TABLE 1

Figure 3:
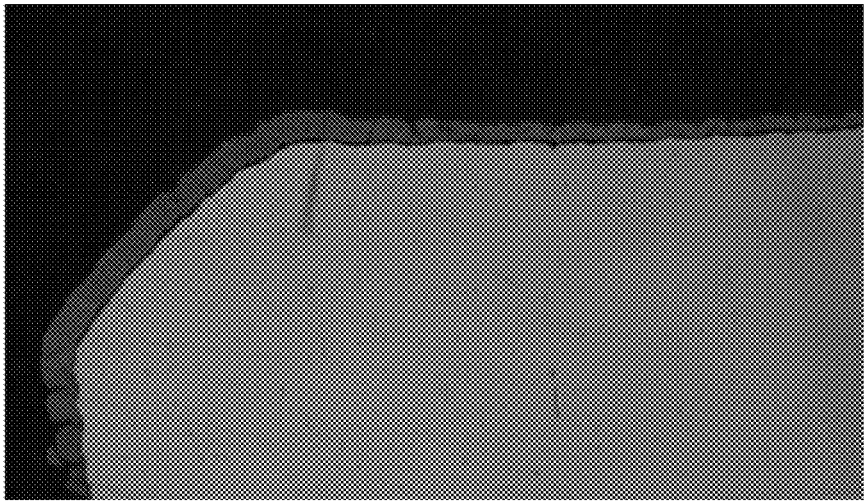
Figure 4:
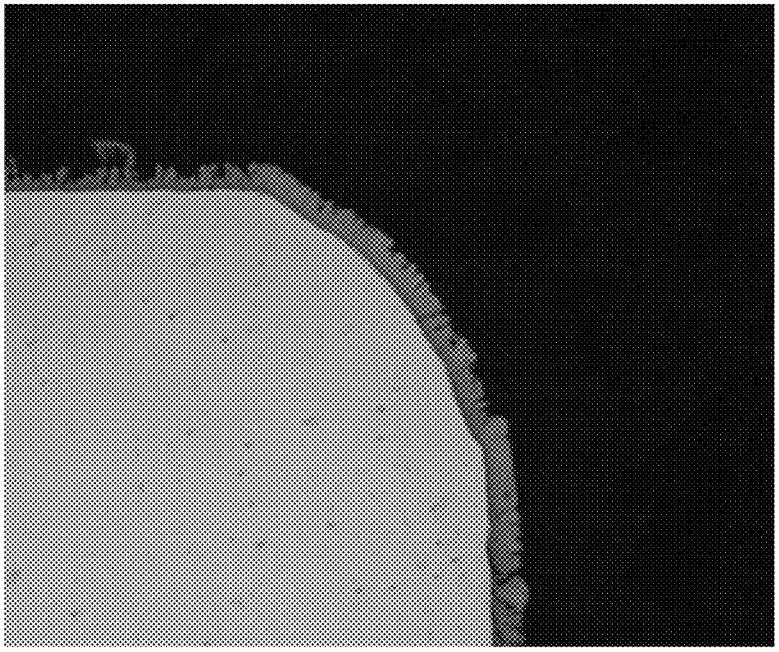
Figure 5:
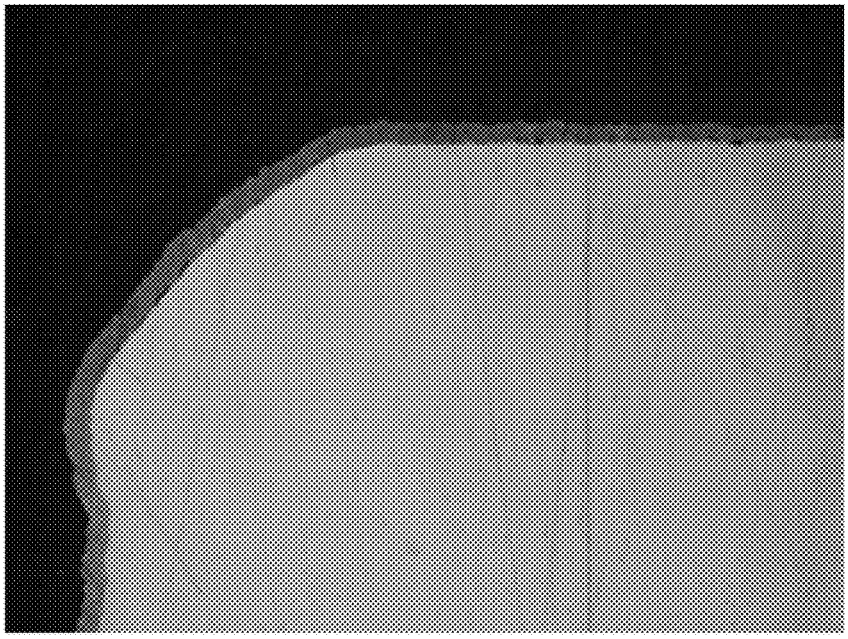

| | Bath composition | | | Electroplating Conditions | | | | Plated layer | | | |
|---|---|---|---|---|---|---|---|---|---|---|---|
| | Ionic liquids | | | | | | | | | | |
| Run No. | w/wo aluminum salt | Additive | Propylene carbonate | Temperature (° C.) | Current density (A/dm2) | Time (min) | Atmosphere | Current efficiency (%) | Thickness (um) | Appearance & cross section | Workability |
| 1 | | | | | | | | | | | |
| 2 | EMIMCl 40 mol % + AlCl3 60 mol % | Sodium dodecyl sulfate 1 wt % | 0 | 70 | 2 | 140 | $N_2$ gas | 100 | 50 | Dense, nodule on corner | Good |
| 3 | EMIMCl 40 mol % + AlCl3 60 mol % | Sodium dodecyl sulfate 1 wt % | 2 wt % | 70 | 2 | 140 | $N_2$ gas | 100 | 50 | Dense, free of nodules | Good |
| 4 | EMIMCl 40 mol % + AlCl3 60 mol % | Sodium dodecyl sulfate 3 wt % | 1 wt % | 80 | 2 | 140 | N2 gas | 100 | 50 | Dense, free of nodules | Good |
| 5 | EMIMCl 40 mol % + AlCl3 60 mol % | Sodium dodecyl sulfate 3 wt % | 2 wt % | 70 | 2 | 140 | N2 gas | 100 | 50 | Dense, free of nodules | Good |
| 6 | EMIMCl 40 mol % + AlCl3 60 mol % | Sodium dodecyl sulfate 6 wt % | 2 wt % | 80 | 2 | 140 | N2 gas | 100 | 50 | Dense, free of nodules | Good |
| 7 (FIG. 2) | EMIMCl 40 mol % + AlCl3 60 mol % | 1-Methyl-2-pyrrolidone 3 wt % | 0 | 70 | 2 | 140 | N2 gas | 100 | 50 | Nodular | Not good |
| 8 (FIG. 3 | EMIMCl 40 mol % + AlCl3 60 mol % | 1-Methyl-2-pyrrolidone 3 wt % | 2 wt % | 70 | 2 | 140 | N2 gas | 100 | 50 | Dense, free of nodules | Good |
| 9 (FIG. 4) | BASF Al-03* | | 0 | 80 | 2 | 140 | N2 gas | 100 | 50 | Dense, nodules on corner | Good |
| 10 (FIG. 5) | BASF Al-03* | | 2 wt % | 80 | 2 | 140 | N2 gas | 100 | 50 | Dense, free of nodules | Good |

*Refers to BASF BASIONICS ™ Al 03, a conventional aluminum electroplating solution including sulfur-free conventional plating bath additives marketed by BASF Corporation, Rhineland-Palatinate, Germany The ionic liquid aluminum electroplating solution may further comprise a dry salt of a reactive element or other compound of a reactive element if the aluminum alloy is to be applied, as hereinafter described. Both salts/compounds (aluminum and reactive element) are dissolved in the ionic liquid and both metals are electrochemically deposited from the bath as an alloy. The amount of each salt/compound in the bath should be such that the bath is liquid at room temperature and that it forms a good deposit as determined, for example, by SEM micrograph. "Reactive elements" include silicon (Si), hafnium (Hf), zirconium (Zr), cesium (Cs), lanthanum (La), yttrium (Y), tantalum (Ta), titanium (Ti), rhenium (Re), or combinations thereof. Exemplary dry salts of the reactive element include dry hafnium salts, for example, anhydrous hafnium chloride ($HfCl_4$), dry silicon salts, for example, anhydrous silicon chloride, dry zirconium salts, for example, anhydrous Zirconium (IV) chloride ($ZrCl_4$), dry cesium salts, dry lanthanum salts, dry yttrium salts, dry tantalum salts, dry titanium salts, dry rhenium salts, or combinations thereof. "Dry salts" are substantially liquid/moisture-free.

The concentration of reactive element in the metal or alloy deposit comprises greater than about 0 wt % to about 10 wt % (i.e., the ratio of reactive element to aluminum throughout the deposit, no matter the number of layers, desirably remains constant). In the ionic liquid aluminum electroplating solution, the concentration of hafnium chloride comprises about 0.001 wt % to about 5 wt %, preferably about 0.0025 to about 0.100 wt %. This preferred range is for a single layer. Multiple layers with thin hafnium concentrated layers would require higher bath concentrations of $HfCl_4$. A similar concentration range of reactive element salts other than hafnium chloride in the ionic liquid aluminum electroplating solution may be used. The salt of the reactive element is preferably in a +4 valence state because of its solubility in the ionic liquid aluminum electroplating solution, however other valance states may be used if the desired solubility is present. While chloride salts have been described, it is to be understood that other reactive element salts may be used such as, for example, reactive element salts of acetate, hexafluorophosphate, and tetrafluoroborate anions. The anion of the reactive element salt may be different or the same as the anion of the aluminum salt. Reactive elements have the potential to spontaneously combust and react with water. By alloying the reactive element salt with aluminum in the ionic liquid aluminum electroplating solution in a single electroplating step in accordance with exemplary embodiments, the reactivity of the reactive element and its susceptibility to oxidation is decreased, thereby making deposition simpler and safer than conventional two step aluminum deposition processes. In addition, the lower electroplating temperatures used for electroplating aluminum or an aluminum alloy from the ionic liquid aluminum electroplating solution containing propylene carbonate as hereinafter described may reduce sublimation of the reactive element salt (e.g., hafnium chloride) from the electroplating bath.

Still referring to FIG. 1, method 10 for producing an aluminum coating on a substrate continues by applying aluminum or an aluminum alloy to at least one (activated or not) surface of the component by electroplating the substrate (masked or unmasked) under electroplating conditions in the ionic liquid aluminum electroplating solution provided in step 14 (step 16). The ionic liquid aluminum electroplating solution is in a plating bath. The step of applying aluminum or the aluminum alloy is performed at electroplating conditions as hereinafter described, and may be performed in ambient air (i.e., in the presence of oxygen). It is preferred that the electroplating be performed in a substantially moisture-free environment where the plating bath is used. For example, and as will be appreciated by those of ordinary skill in the art, an ionic liquid aluminum electroplating solution remains stable up to a water content of 0.1 percent by weight. At higher water content, electrodeposition of aluminum ceases, chloroaluminates are formed, water electrolyzes into hydrogen and oxygen, and the ionic plating bath forms undesirable compounds and vapors. Other plating bath embodiments will be expected to experience similar problems at higher water content. Where plating baths are used, a commercial electroplating tank or other vessel equipped with a cover and a purge gas supply as known in the art may be used to form positive pressure to substantially prevent the moisture from the air getting into the ionic liquid aluminum electroplating solution. Suitable exemplary purge gas may be nitrogen or other inert gas, dry air, or the like.

The aluminum or aluminum alloy layer is formed on the substrate using the ionic liquid aluminum electroplating solution with one or more aluminum anodes and the substrate (s) to be coated (i.e., plated) as cathode. A pure reactive element anode may be used to replenish the reactive element fraction, the aluminum being replenished continuously through the one or more aluminum anodes. Suitable electroplating conditions vary depending on the desired thickness of the electroplated layer(s) or coating. The aluminum or aluminum alloy may be applied directly on the substrate to form the aluminum or aluminum alloy layer(s). For example, the time and current density are dependent on each other, i.e., if the plating time is increased, the current density may be decreased and vice versa. Current density is essentially the rate at which the deposit forms. For example, if the current density is doubled, the time is cut in half. In order to produce clear bright deposits, the current density may have to increase as the reactive element concentration increases. Suitable optimum current densities for electroplating aluminum or an aluminum alloy from an ionic liquid aluminum electroplating solution containing EMIMCl×$AlCl_3$ and propylene carbonate are about 1-3 amperes/decimeters$^2$. Suitable optimum electroplating temperatures for electroplating aluminum or an aluminum alloy from an ionic liquid aluminum electroplating solution containing propylene carbonate range between about 60° to about 80° C. The temperatures at the lower end of the range are below conventional ionic liquid aluminum electroplating temperatures of 75° C. to 100° C. It is to be understood that the current densities and/or electroplating temperatures may be lower or higher than, respectively, 1-3 amperes/decimeters$^2$ and about 60° to about 80° C. For example, electroplating may be done at 1 ampere/decimeters$^2$ at 50° C. and 3 ampere/decimeters$^2$ at 90° C.

The propylene carbonate increases conductivity of the electroplating bath and reduces viscosity thereof, allowing the bath temperature to be lower than the conventional electroplating bath temperatures. The lower bath temperature uses less power, reduces bath decomposition, and extends bath life. In addition, as noted previously, when hafnium chloride is included in the ionic liquid aluminum electroplating solution, the lower bath temperature substantially eliminates sublimation thereof (along with substantially eliminating sublimation of the aluminum chloride). As noted above, the propylene carbonate in the ionic liquid aluminum electroplating solution also extends bath life (see, e.g., Table 2 below). While not wishing to be bound by any theory, it is believed that when the propylene carbonate decomposes, the decomposition products volatize, preventing contaminant build-up.

As a result of the electroplating step 16, the aluminum coating is present on the surface of the substrate. After removal of the plated substrate (e.g., a plated component) from the ionic liquid aluminum electroplating solution, the plated substrate may be rinsed with a solvent such as acetone, alcohol, propylene carbonate, or a combination thereof. As ionic liquids are water-reactive as described previously, it is preferred that the plated component be rinsed with at least one acetone rinse to substantially remove the water-reactive species in the ionic liquid before rinsing the plated component with at least one water rinse. The plated substrate may then be dried, for example, by blow drying or the like.

In embodiments where chloride salts are employed, it will be appreciated that it is difficult to remove all the chlorides during such rinsing step, and while not wishing to be bound by any particular theory, it is believed that residual chloride may remain on the surface of the plated substrate trapped under aluminum oxide (alumina or $Al_2O_3$) scale formed on the surface of the plated substrate. Performance of the coated substrate (e.g., a plated component) may suffer if the scale and residual chloride (hereinafter collectively referred to as "chloride scale") are not substantially removed. The chloride scale may be removed by an alkaline rinse, an acid rinse using, for example, mineral acids such as HCl, $H_2SO_4$, $HNO_3$, or organic acids such as citric or acetic acid, or by an abrasive wet rinse because the plating is non-porous. The alkaline rinse may be an alkaline cleaner, or a caustic such as sodium hydroxide, potassium hydroxide, or the like. A desired pH of the alkaline rinse is from about 10 to about 14. The abrasive wet rinse comprises a water jet containing abrasive particles. Both the alkaline rinse and the abrasive wet rinse etch away the chloride scale and a very thin layer of the plating without etching the substrate of the component. For example, about 0.1 microns of the plating may be etched away. After removal of the chloride scale, the plated substrate may be rinsed with at least one water rinse and then dried, for example, by blow drying or the like or using a solvent dip such as, for example, 2-propanol or ethanol to dry more rapidly.

The aluminum coating on the surface of the substrate may be transformed into an aluminide coating, used for example on superalloy substrates for high temperature oxidation resistance. An "aluminide" coating refers to an aluminum coating that has been thermally diffused into a base metal of the substrate. To transform the aluminum coating on the plated substrate to an aluminide coating, the aluminum layer may be bonded and diffused into the base metal to produce the aluminide coating. As used herein, the term "aluminide coating" refers to the coating after diffusion of aluminum into the base metal of the substrate. If conventional aluminum diffusion temperatures of about 1050° C. to about 1100° C. are used, undesirable microstructures may be created. To substantially avoid creating undesirable microstructures, the plated substrate may be heat treated in a first heating step at a first temperature less than about 1050° C., preferably about 600° C. to about 650° C. and held for about 15 to about 45 minutes (step 24) and then further heating at a second temperature of about 700° C. to 1050° C. for about 0.50 hours to about two hours (step 25). The second heating step causes diffusion of the aluminum or aluminum alloy into the component. Heat treatment may be performed in any conventional manner. At the relatively low temperatures of the first and second heating steps, the coating materials do not diffuse as deeply into the substrate as with conventional diffusion temperatures, thereby reducing embrittlement of the substrate. Thus, the mechanical properties of the coating are improved. However, at such temperatures, alpha alumina, which increases the oxidation resistance of the substrate metal as compared to other types of alumina, may not be formed as the surface oxide. Therefore, an optional third heat treatment at about 1000° C. to about 1050° C. for about 5 to about 45 minutes may be desired in order to substantially ensure formation of an alpha alumina oxide layer in the coating. The third heat treatment may be performed, for example, in a separate furnace operation. Alternatively, other techniques to form the alpha alumina surface layer after the first and second heat treatments may be used including, for example, formation of high purity alpha alumina by, for example, a CVD process or a sol gel type process as known in the art.

In accordance with another exemplary embodiment, the plated substrate may be heat treated in the first heating step followed by further heating at a second temperature of about 750° C. to about 900° C. and holding for a longer residence time of about 12 to about 20 hours to diffuse aluminum into the substrate forming the alpha alumina (or alpha alumina alloy) surface layer (step 27). Costs are reduced by avoiding additional heating in a separate furnace operation or using other techniques to form the alpha alumina surface layer. In addition, a separate aging step as known in the art is rendered unnecessary.

The aluminum coating produced in accordance with exemplary embodiments may comprise one or more layers, formed in any sequence, and having varying concentrations of reactive elements, if any. For example, a ternary deposit of aluminum, and two reactive elements may be performed by electroplating in an ionic liquid aluminum electroplating solution that includes two dry reactive element salts in addition to the ionic liquid, aluminum salt, and the propylene carbonate. A binary deposit could be performed more than once. For example, the component may be electroplated in an ionic liquid aluminum electroplating solution containing, for example, a dry hafnium salt to form an aluminum-hafnium layer followed by another dip in an ionic liquid aluminum electroplating solution containing, for example, a dry silicon salt to form an aluminum-silicon layer. The rinsing and heating steps may optionally be performed between dips. A pure aluminum layer may be deposited over and/or under an aluminum alloy layer having a concentration of about 0.5 wt % to about 10 wt % of the reactive element or the reactive element may be distributed throughout an aluminum layer. Several elements may be deposited simultaneously by including their dry salts in the ionic liquid aluminum electroplating solution. For example, hafnium and silicon salts at low concentrations may be introduced into the ionic liquid aluminum electroplating solution or alternatively, a hafnium-aluminum layer deposited, then a silicon-aluminum layer, and then a pure aluminum layer formed. While the pure aluminum layer is described as the uppermost layer, it is to be understood that the layers may be formed in any sequence.

EXAMPLES

The following examples were prepared according to the steps described above. The examples are provided for illustration purposes only, and are not meant to limit the various embodiments of the present invention in any way.

Example 1

A round stainless steel substrate with 1 inch diameter and $1/8^{th}$ inch thickness was electroplated using an ionic liquid aluminum electroplating solution of 98 weight percent (wt %) EMIMCl-$AlCl_3$ with a molar ratio of 1:1.5 and 2 weight percent (wt %) propylene carbonate. Electroplating conditions included the following:

Current density=2 amps/$dm^2$ (decimeter$^2$)

Time=depending on thickness desired

Bath Temperature=70° C.

Figure 6:
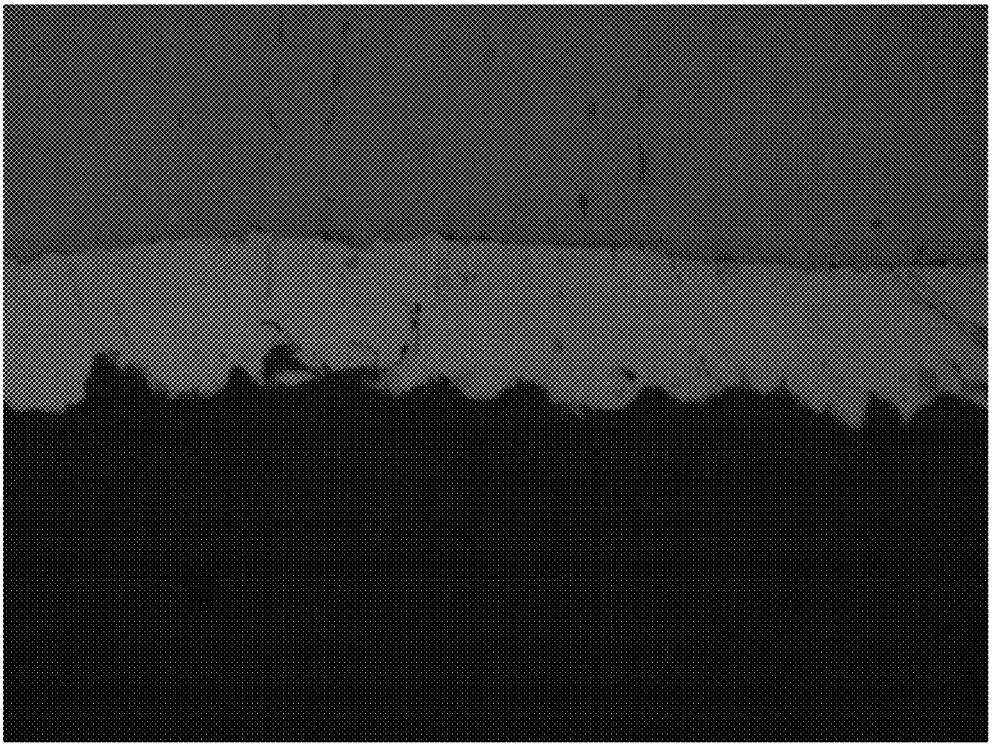
FIG. 6 is a photograph of the cross-section of the electroplated aluminum deposit from EXAMPLE 1 as seen by a metallurgy microscope (magnified 200×)
Figure 7:
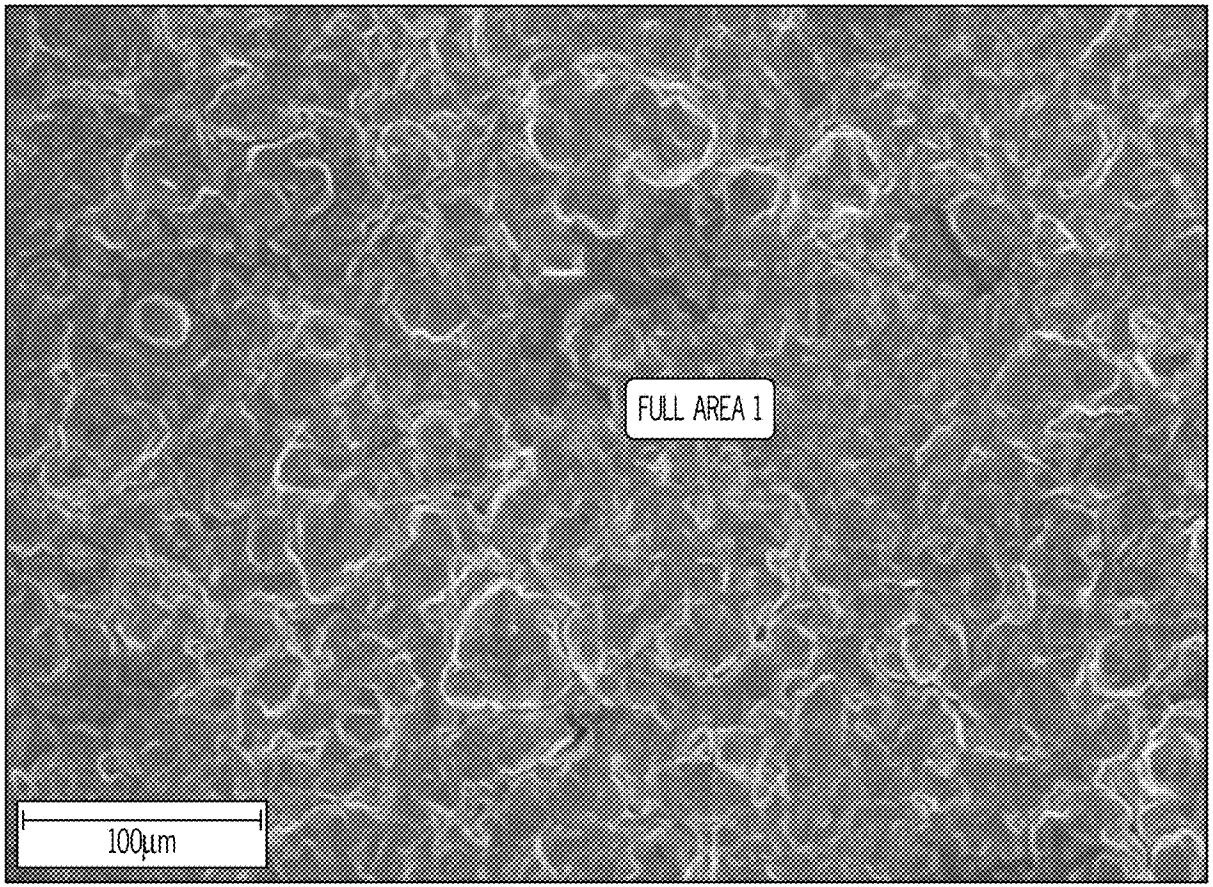
FIG. 7 is a scanning electron micrograph (SEM) depicting the appearance of the electroplated aluminum deposit from EXAMPLE 1 (magnified 250×).

The electroplated sample was rinsed and the chloride scale removed. The plated/coated substrate was analyzed by metallurgy microscope (FIG. 6, 200× magnification) and SEM micrograph (FIG. 7, 250× magnification), showing a substantially uniform surface appearance without nodules.

Example 2

The bath life of an ionic liquid aluminum electroplating solution containing 94-96 wt % EMIM-Cl—$AlCl_3$ with a molar ratio of 1:1.5 and 4-6 wt % propylene carbonate was compared with the bath life of commercially available ionic liquid aluminum electroplating solutions of BASF BASIONICS™ Al 03 (also referred to herein as BASF Al-03) and IoLiTec EP-0003 (both of which contain sulfur-free conventional plating bath additives). As shown in TABLE 2 below, the aluminum coating electroplated from the commercially available solutions had nodules when bath life exceeded 50 amperes-hours/L. However, by replenishing the propylene carbonate in the plating bath of ionic liquid aluminum electroplating solution comprising EMIMCl×AlCl3 and propylene carbonate, and electroplating at the electroplating conditions shown below, the bath life of the ionic liquid aluminum electroplating solution containing propylene carbonate was at least three times greater than the bath life of the commercially available ionic aluminum electroplating solutions without propylene carbonate, logging over 170 amperes-hours/L with no nodule formation in the aluminum deposit. Additionally, the maximum plating rate increased up to 50% by increasing the maximum viable plating current density and the plating temperature decreased as a result, thereby reducing energy consumption.

TABLE 2

| Ionic liquid plating bath | BASF BASIONICS Al 03 | IoLiTec EP-0003 | EMIMCl-$AlCl_3$ with molar ratio of 1:1.5 (94-96 wt %) with 4-6 wt % propylene carbonate |
|---|---|---|---|
| Electroplating temperature (° C.) | 95 | 75 | 70 |
| Electroplating current density (amp/$dm^2$) | 1-2 | 1-1.5 | 2-3 |
| Bath life with no nodule in Al deposit (amp-hour/Liter) | 50 | 50 | >170 |

From the foregoing, it is to be appreciated that propylene carbonate as a surface modifier for ionic liquid aluminum electroplating solutions, processes for electroplating aluminum therefrom, and methods for producing an aluminum coating using the same are provided. The bath chemistry and physical parameters are optimized, resulting in a dense aluminum coating with better surface uniformity and fewer defects and increased plating rate, enabling lower bath temperatures, thereby contributing to reduced energy consumption and less bath decomposition with consequent extended bath life.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An ionic liquid aluminum electroplating solution in a plating bath that produces an aluminum coating on a substrate, comprising:

an ionic liquid;

an aluminum salt, wherein the ionic liquid and aluminum salt are present in an amount of from about 90 to about 100 weight percent (wt %) based upon a total weight of the ionic liquid aluminum electroplating solution;

a concentration of propylene carbonate greater than 0 weight percent (wt %) to 6 weight percent (wt %) based upon the total weight of the ionic liquid aluminum electroplating solution; and a concentration of 1-Methyl-2-pyrrolidone as a solvent or surfactant, the solvent or surfactant present in an amount of from 1 to 6 weight percent (wt %) based upon the total weight of the ionic liquid aluminum electroplating solution.

2. The ionic liquid aluminum electroplating solution of claim 1, wherein the ionic liquid comprises 1-Ethyl-3-methylimidazolium chloride (EMIM-Cl) and the aluminum salt comprises aluminum trichloride (AlCl3) in a molar ratio of 1:1.5.

3. The ionic liquid aluminum electroplating solution of claim 1, further comprising a concentration of sodium dodecyl sulfate as a second solvent or surfactant.

4. The ionic liquid aluminum electroplating solution of claim 1, further comprising a dry salt of a reactive element, the reactive element being selected from the group consisting of hafnium, zirconium, cesium, lanthanum, silicon, rhenium, yttrium, tantalum, titanium, and combinations thereof and the dry salt of the reactive element being selected from the group consisting of hafnium chloride, zirconium chloride, cesium chloride, lanthanum chloride, silicon chloride, rhenium chloride, yttrium chloride, tantalum chloride, titanium chloride, and combinations thereof.

5. The ionic liquid aluminum electroplating solution of claim 4, wherein the reactive element comprises about greater than 0 wt % to about 10 wt % based upon the total weight of the ionic liquid aluminum electroplating solution.

6. A method for producing an aluminum coating on a substrate, the method comprising:

applying aluminum or an aluminum alloy to at least one surface of the substrate by electroplating under electroplating conditions in an ionic liquid aluminum electroplating solution comprising an ionic liquid, an aluminum salt, wherein the ionic liquid and aluminum salt are present in an amount from about 90 to about 100 weight percent (wt %) based upon a total weight of the ionic liquid aluminum electroplating solution, a concentration of propylene carbonate greater than 0 weight percent (wt %) to 6 weight percent (wt %) based upon the total weight of the ionic liquid aluminum electroplating solution and a concentration of 1-methyl-2-pyrrolidone as a solvent or surfactant, the solvent or surfactant present in an amount from 1 to 6 weight percent (wt %) based upon the total weight of the ionic liquid aluminum electroplating solution.

7. The method of claim 6, further comprising the step of providing the ionic liquid electroplating solution prior to the applying step.

8. The method of claim 6, wherein the step of providing the ionic liquid aluminum electroplating solution comprises mixing the ionic liquid and the aluminum salt in a 1:1.5 molar ratio.

9. The method of claim 6, wherein the step of providing the ionic liquid aluminum electroplating solution further comprises mixing a dry salt of a reactive element with the ionic liquid, aluminum salt, propylene carbonate, and 1-methyl-2-pyrrolidone, wherein the reactive element is selected from the group consisting of hafnium, zirconium, cesium, lanthanum, silicon, rhenium, yttrium, tantalum, titanium, and combinations thereof, the reactive element comprises about 0.05% to about 10 wt % of the ionic liquid aluminum electroplating solution, and the dry salt of the reactive element is selected from the group consisting of hafnium chloride, zirconium chloride, cesium chloride, lanthanum chloride, silicon chloride, rhenium chloride, yttrium chloride, tantalum chloride, titanium chloride, and combinations thereof.

10. The method of claim 6, wherein the step of applying aluminum or an aluminum alloy comprises electroplating at a temperature of about 60° C. to about 80° C. and a current density of about 1 to about 3 amperes/decimeters2 (dm2).

11. A process for electroplating aluminum or an aluminum alloy from an ionic liquid aluminum electroplating solution comprising:

adding a concentration of propylene carbonate and a concentration of 1-methyl-2-pyrrolidone as a solvent or surfactant to an ionic liquid and aluminum salt solution thereby forming the ionic liquid aluminum electroplating solution, wherein the ionic liquid and aluminum salt are present in an amount from about 90 to about 100 weight percent (wt %) based upon a total weight of the ionic liquid aluminum electroplating solution, the concentration of propylene carbonate is greater than 0 weight percent (wt %) to 6 weight percent (wt %) based upon the total weight of the ionic liquid aluminum electroplating solution and the concentration of the solvent or surfactant is present in an amount from 1 to 6 weight percent (wt %) based upon the total weight of the ionic liquid aluminum electroplating solution; and electroplating at least one surface of a substrate under electroplating conditions in the ionic liquid aluminum electroplating solution to form an aluminum coating on the substrate.

12. The process of claim 11, wherein the ionic liquid comprises 1-Ethyl-3-methylimidazolium chloride (EMIM-Cl) and the aluminum salt comprises aluminum trichloride (AlCl3) in a molar ratio of 1:1.5.

13. The process of claim 11, wherein the electroplating conditions comprise a current density of 1-3 amperes/dm2 and an electroplating temperature of about 60 to about 80° C.

* * * * *